US005091711A

United States Patent [19]

Hirotsune

[11] Patent Number: 5,091,711

[45] Date of Patent: Feb. 25, 1992

[54] CURRENT TRANSFORMER MOUNTING MECHANISM FOR CIRCUIT BREAKER

[75] Inventor: Kojo Hirotsune, Hiroshima, Japan

[73] Assignee: Mitsubishi Denki Kabushiki Kaisha, Tokyo, Japan

[21] Appl. No.: 706,186

[22] Filed: May 28, 1991

[30] Foreign Application Priority Data

Jun. 12, 1990 [JP] Japan ..... 2-62519[U]

[51] Int. Cl.[5] ..... H01F 15/02

[52] U.S. Cl. ..... 336/65; 336/67; 336/210; 361/38

[58] Field of Search ..... 361/38, 39, 41; 336/65, 336/67, 68, 210

[56] References Cited

U.S. PATENT DOCUMENTS 2,699,531 1/1955 Massar ..... 336/210
2,897,463 7/1959 Denham ..... 336/65
4,283,699 8/1981 Ehrgott et al. ..... 336/210
4,603,314 7/1986 Fukonaga et al. ..... 336/65

*Primary Examiner*—Thomas J. Kozma
*Attorney, Agent, or Firm*—Burns, Doane, Swecker & Mathis

[57] ABSTRACT

Current transformer mounting mechanism which mounts a current transformer having a core on a circuit breaker to diminish impact caused by switching operation comprising: at least one substantially U-shaped fitting board having curved portions at both ends thereof; at least one setscrew for mounting said fitting board to the core of the current transformer; and a current transformer mounting portion having opposing walls, each wall being provided with a shoulder where the fitting board being fixed; the current transformer being mounted to the current transformer mounting portion by inserting the fitting board to the current transformer mounting portion. The fitting board is preferably provided with embossed tabs at curved portions thereof.

2 Claims, 5 Drawing Sheets

CURRENT TRANSFORMER MOUNTING MECHANISM FOR CIRCUIT BREAKER

BACKGROUND OF THE INVENTION

1. Field of the Invention

The present invention relates to a circuit breaker and, more specifically, to a circuit breaker which has an improved current transformer mounted mechanism.

2. Description of the Prior Art

FIGS. 4 and 5 show a current transformer mounting mechanism conventionally used for a circuit breaker. In the figures, denoted 1 is a circuit breaker body and 1*a* is current transformer mounting portion, 2 a main circuit conductor, 3 a current transformer cover, 4 a current transformer. The current transformer 4 comprises winding portions 4*a*, a core 4*b*, and core setscrews 4*c*.

Next, a mounting method will be described. The current transformer is mounting by fixing the core 4*b* with a shoulder 1*d* of the current transformer mounting portion at four points arranged up and down, and from side to side.

With the conventional circuit breaker thus far described, since the current transformer is mounted by the above method, impact caused by the switching operation is directly transmitted to the current transformer 4, leading to a possibility of deterioration of parts constituting the current transformer. Further, since the core 4*b* is formed of thin sheets, there is a problem that insertion of the core 4*b* becomes a difficult due to the thin sheets slipping during assembly.

SUMMARY OF THE INVENTION

It is therefore an object of the present invention to provide a current transformer mounting mechanism for circuit breaker when diminishes the impact caused by the switching operation, makes it easy to insert the current transformer to the mounting portion, and accurately fixes the current transformer.

In order to attain the object, according to the present invention, there is provided a current transformer mounting mechanism which mounts a current transformer having a core on a circuit breaker comprising: at least one substantially U-shaped fitting board having curved portions at both ends thereof; at least one setscrew for mounting said fitting board to the core of the current transformer; and a current transformer mounting portion having opposing walls, each wall being provided with a shoulder where the fitting board being fixed; the current transformer being mounted to the current transformer mounting portion by inserting the fitting board to the current transformer mounting portion. The fitting board is provided with embossed tabs for fixing the current transformer at the curved portion of the current transformer mounting portion.

In the present invention, a fitting board contacts with a current transformer fitting portion to diminish impact caused to switching operation and the fitting board makes it possible to mount and dismount a current transformer with ease.

The above features and advantages of the invention and manner of realizing them will become more apparent, and the invention itself will best be understood, from a study of the following description and appended claims, with reference to the attached drawing showing a some preferred embodiment of the invention.

DETAILED DESCRIPTION OF PREFERRED EMBODIMENTS

Figure 1:
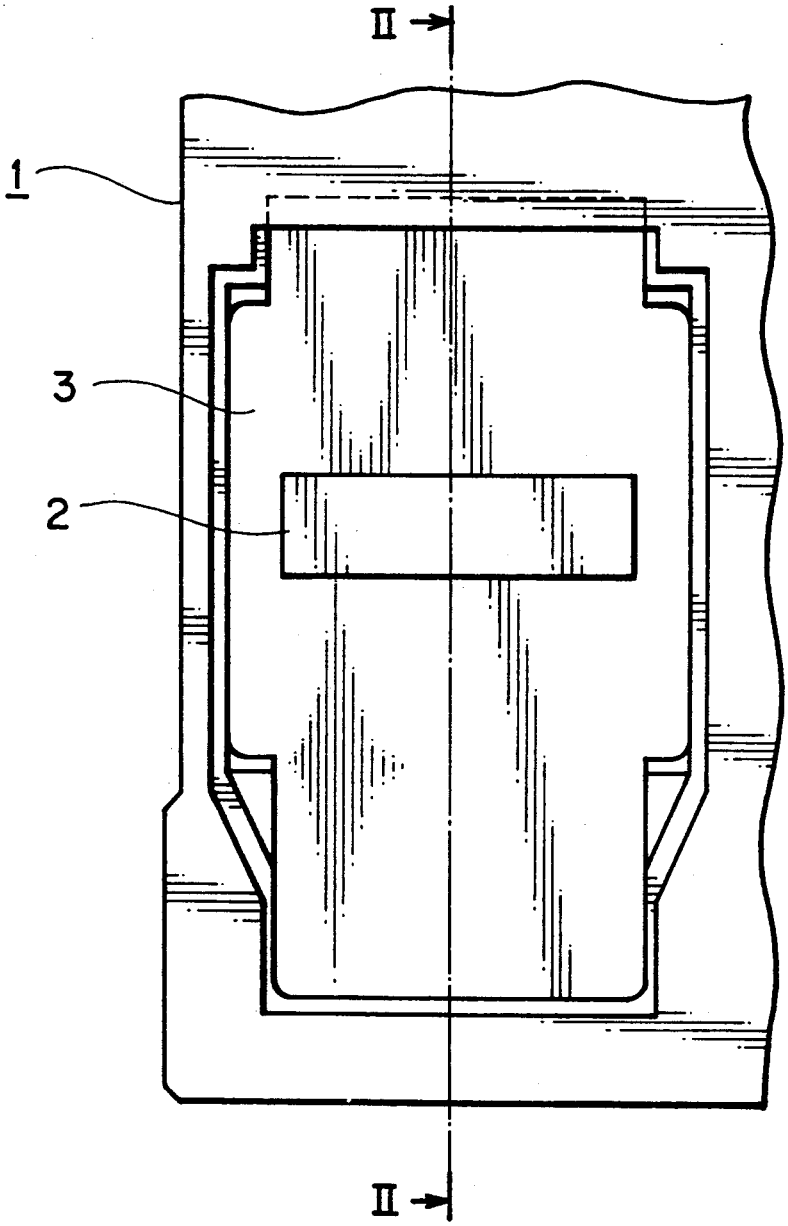
FIG. 1 is a front elevation of principal part of the circuit breaker according to one embodiment of the present invention.
Figure 2:
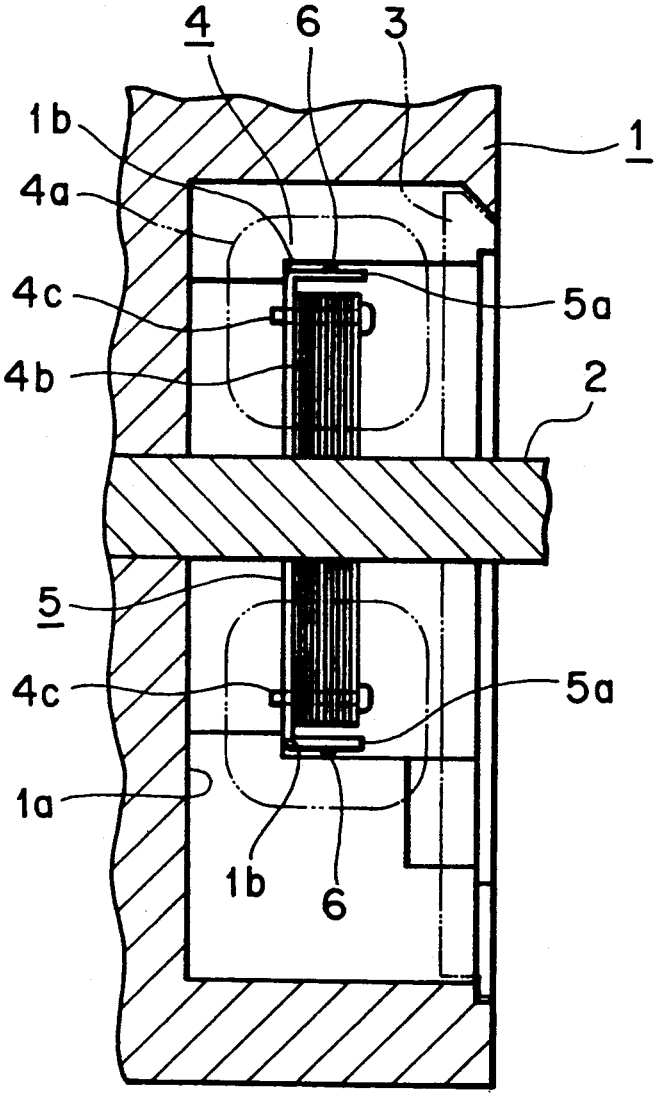
FIG. 2 shows a cross-sectional view taken along the line II—II of FIG. 1.
Figure 3:
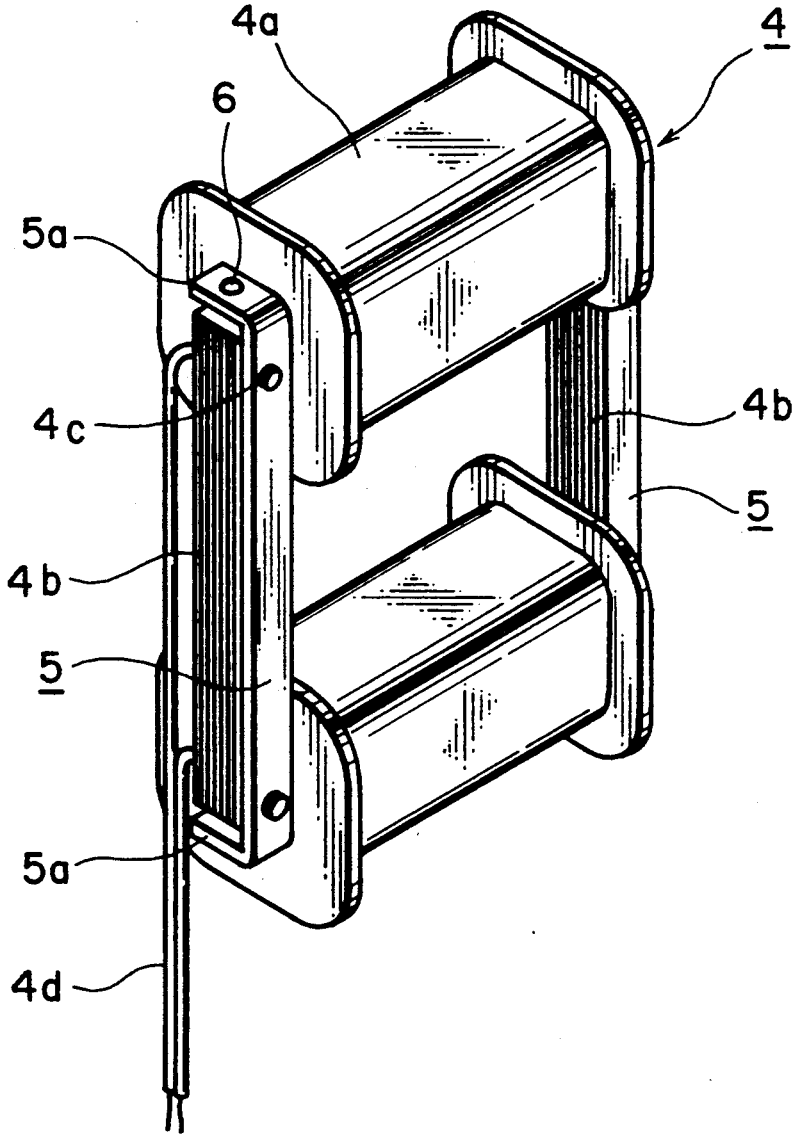
FIG. 3 illustrates a perspective view of the current transformer described in FIG. 2.
Figure 4:
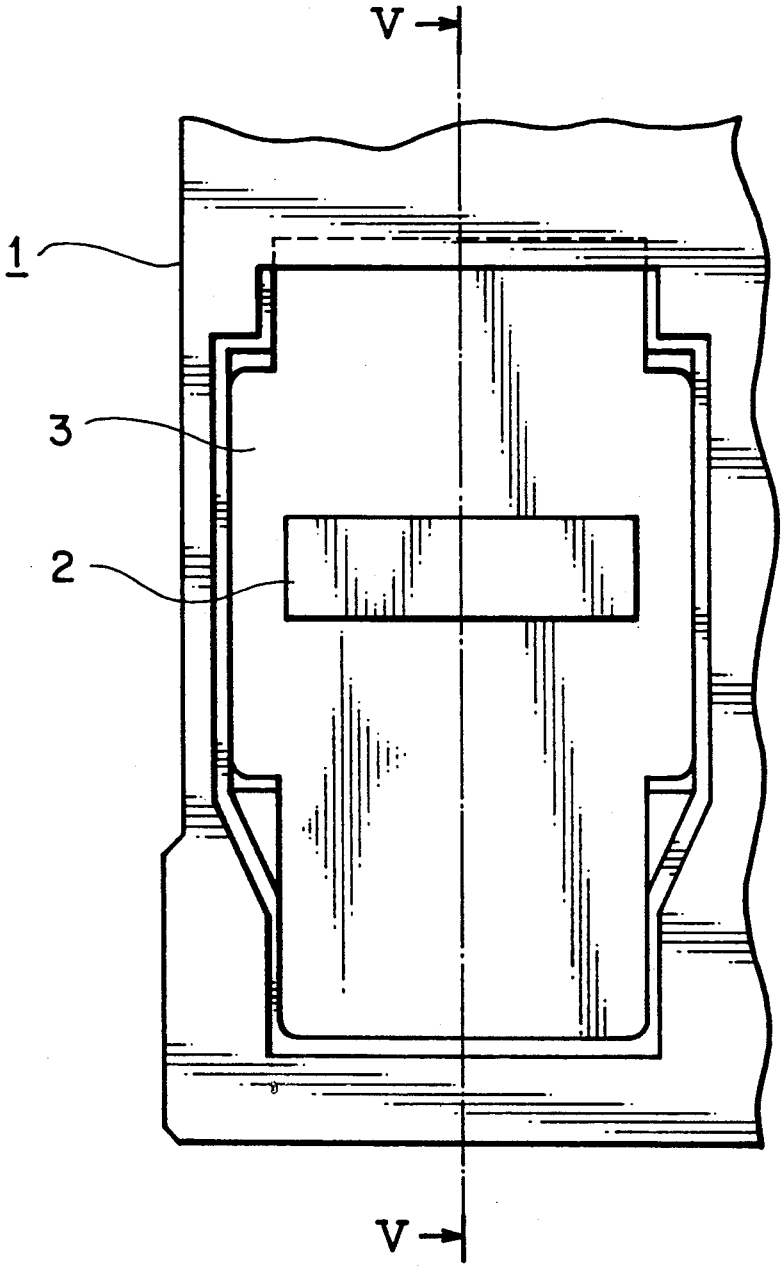
FIG. 4 PRIOR ART
FIG. 4 shows a front elevation of the principal part of a conventional circuit breaker.
Figure 5:
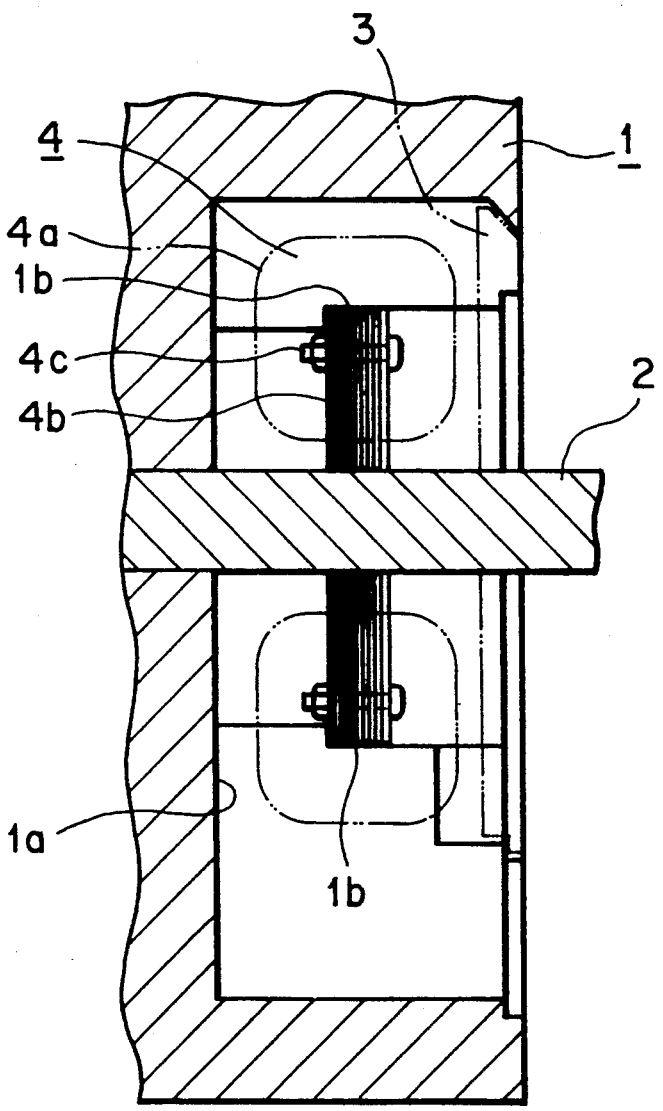
FIG. 5 PRIOR ART
FIG. 5 is a cross-sectional view taken along the line V—V of FIG. 4.

One embodiment of the present invention will be described with reference to FIGS. 1 to 3. FIG. 1 is a front elevation of principal part of the circuit breaker according to one embodiment of the present invention. FIG. 2 shows a cross sectional view taken along the line II—II of FIG. 1. FIG. 3 illustrates a perspective view of the current transformer described in FIG. 2. The component parts identical with or equivalent to the conventional example given above are designated by the same symbols. In the figures, denoted 5 is a U-shaped fitting board having curved portions 5*a* and symmetrically mounted to a core 4*b* with setscrews 4*c*. Reference numeral 6 shows embossed tabs provided to the curved portions 5*a* of the fitting board 5. Denoted 4*d* is an outgoing portion of the current transformer 4.

In the current transformer as described above, impact in switching operation is not directly transmitted to the core 4*b* and the winding portion 4*a*, and force transmitted from the embossed tabs 6 is diminished by resilience of the curved portion 5*a*. Meanwhile, the design in which the distance between the embossed tabs is slightly longer than the diameter of the mounting portion 1*a* is able to diminish looseness of the current transformer. Further, by virtue of the existence of rounded portions of the curved portions of the fitting board 5, there is another advantage that mounting or dismounting of the current transformer becomes easier without being caught by the current transformer mounting portion in assembly.

While in the aforementioned embodiment, the case where the present invention is applied to circuit breakers has been described, it is to be noted that the present invention may be applied to other parts of circuit breakers or equipment other than circuit breakers and similar effect will be obtained.

As described above, the present invention provides a current transformer mounting mechanism for circuit breaker in which impact in switching operation is less apt to be transmitted and a current transformer is inserted to and accurately mounted to its mounting portion with ease.

What is claimed is:

1. A current transformer having a core and a current transformer mounting mechanism for mounting said current transformer on a circuit breaker comprising:

at least one substantially U-shaped fitting board having curved portions at both ends thereof;

at least one setscrew for mounting said fitting board to the core of the current transformer; and a current transformer mounting portion having opposing walls, each wall being provided with a shoulder; the fitting board being fixed to each shoulder; said current transformer being mounted to the current transformer mounting portion by inserting the fitting board to the current transformer mounting portion.

2. Current transformer and mounting mechanism as claimed in claim 1, wherein said fitting board is provided with embossed tabs at on said curved portions.

* * * * *